US006764302B2

(12) United States Patent
Eberspach et al.

(10) Patent No.: US 6,764,302 B2
(45) Date of Patent: Jul. 20, 2004

(54) ATOMIZING NOZZLE FOR A BURNER, ESPECIALLY FOR A HEATER THAT CAN BE USED ON A VEHICLE

(75) Inventors: Günter Eberspach, Wolfschlugen (DE); Walter Blaschke, Deizisau (DE)

(73) Assignee: J. Eberspacher GmbH & Co. KG, Esslingen (DE)

( * ) Notice: Subject to any disclaimer, the term of this patent is extended or adjusted under 35 U.S.C. 154(b) by 0 days.

(21) Appl. No.: 10/348,408

(22) Filed: Jan. 21, 2003

(65) Prior Publication Data

US 2003/0155435 A1 Aug. 21, 2003

(30) Foreign Application Priority Data

Feb. 21, 2002 (DE) ..... 102 07 311

(51) Int. Cl.[7] ..... F23D 14/62

(52) U.S. Cl. ..... 431/354; 431/158; 431/185; 431/284; 239/419

(58) Field of Search ..... 431/8, 158, 187, 431/354, 182, 350, 284, 285; 60/737, 748; 239/400, 404, 403, 422, 424, 428; 237/12.3 C

(56) References Cited

U.S. PATENT DOCUMENTS

| | | | | |
|---|---|---|---|---|
| 3,703,259 A | | 11/1972 | Sturgess et al. | |
| 4,653,278 A | * | 3/1987 | Vinson et al. | 60/737 |
| 4,699,587 A | * | 10/1987 | Shimoda et al. | 431/354 |
| 5,176,324 A | * | 1/1993 | Furuse et al. | 239/419 |
| 5,647,538 A | | 7/1997 | Richardson | |
| 6,068,470 A | | 5/2000 | Zarzalis et al. | |
| 6,164,554 A | * | 12/2000 | Pfister et al. | 237/12.3 C |
| 6,244,051 B1 | | 6/2001 | Zarzalis et al. | |
| 2001/0023590 A1 | | 9/2001 | Mandai et al. | |

FOREIGN PATENT DOCUMENTS

| | | |
|---|---|---|
| EP | 0 660 038 A2 | 6/1995 |
| EP | 0 910 776 B1 | 4/1999 |
| EP | 0 933 593 A2 | 8/1999 |
| JP | 07332671 | 12/1995 |

* cited by examiner

*Primary Examiner*—James C. Yeung
(74) *Attorney, Agent, or Firm*—McGlew and Tuttle, P.C.

(57) ABSTRACT

An atomizing nozzle for a burner, especially for a heater that can be used on a vehicle includes a first flow guide element (34), which provides a flow guide surface (40) and has an atomizing lip (48) in an axial end area in relation to a central axis (A) of the nozzle, a second flow guide element (36) defining a first flow space area (30) leading to the atomizing lip (48) together with the first flow guide element (34). A fuel feed device (54) in the second flow guide element (36) is provided for applying fuel through the first flow space area (30) onto the flow guide surface (40) of the first flow guide element (34). Provisions are made for the fuel feed device (54) to have at least one fuel feed channel section (58) in the second flow guide element (36), which said fuel feed channel section (58) is open toward a surface area (44; 44') of the second flow guide element (36) and has a surface normal radial component different from zero.

21 Claims, 2 Drawing Sheets

ATOMIZING NOZZLE FOR A BURNER, ESPECIALLY FOR A HEATER THAT CAN BE USED ON A VEHICLE

FIELD OF THE INVENTION

The present invention pertains to an atomizing nozzle for a burner, especially for a heater that can be used on a vehicle, comprising a first flow guide element that provides a first flow guiding surface and has an atomizing lip in an axial end area in relation to a central axis of the nozzle, a second flow guide element defining a first flow space area leading to the atomizing lip together with the first flow guide element, as well as a fuel feed device in the second flow guide element for applying fuel through the first flow space area onto the flow guide surface of the first flow guide element.

BACKGROUND OF THE INVENTION

A burner that can be used in gas turbines is known from EP 0 910 776 B1. Fuel is injected in this burner by an injection nozzle onto a flow guide surface of a flow guide element ending in an atomizing lip. The fuel leaving the injection nozzle under high pressure passes through a flow space area leading to the atomizing lip before it reaches the flow guide surface of the flow guide element for further distribution and for atomization. The fuel is released here from a surface of the atomizing nozzle, which has a surface normal (or a normal surface) that is essentially parallel to a central axis of the nozzle. The fuel stream, which is also directed partially radially, must be released under high pressure in order to ensure that it will be carried by the air stream before it reaches the flow guide surface of the flow guide element.

The feeding of fuel under high pressure is critical especially in the case of use in automobiles. The reason for this is that the fuel feed lines must be frequently led past components that have very high temperatures. The consequence of a leakage in the area of these lines would be that the fuel, which is under high pressure, would escape in the area of this leak and be possibly atomized. This entails the risk of an immediate inflammation of the fuel in the area of such leaks.

SUMMARY OF THE INVENTION

The object of the present invention is to improve an atomizing nozzle of this class such that it ensures reliable distribution or atomization of the fuel with high reliability of operation.

This object is accomplished according to the present invention by an atomizing nozzle for a burner, especially for a heater that can be used on a vehicle, comprising a first flow guide element, which provides a flow guide surface and has an atomizing lip in an axial end area in relation to the first flow guide element, a second flow guide element defining a flow space area leading to the atomizing lip together with the first flow guide element, as well as a fuel feed device in the second flow guide element for applying fuel through the first flow space area onto the flow guide surface of the first flow guide element.

Provisions are, furthermore, made according to the present invention for the fuel feed device to have at least one fuel feed channel section in the second flow guide element, which said fuel feed channel section is open toward a surface area of the second flow guide element, which has a surface normal radial component different from zero.

It is ensured in the present invention that the fuel is already discharged with a radial component from a fuel feed channel section, of which there is at least one, without the necessity of feed under high pressure. The risk that fuel particles would be carried in the air stream flowing through the flow space area without reaching the flow guide surface of the first flow guide element is thus essentially eliminated.

For example, provisions may be made for the second flow guide element to be tapered downstream of the opening area of the at least one fuel feed channel section in relation to the central axis of the nozzle.

However, it is also possible as an alternative to expand the second flow guide element downstream of the opening area of the at least one fuel feed channel section in relation to the central axis of the nozzle. The expanding configuration of the second flow guide element may be used, furthermore, to provide a fuel release lip at the second flow guide element downstream of the opening area of the at least one fuel feed channel section. The fuel being discharged from the fuel feed channel section consequently moves along the radially outwardly expanding surface of the second flow guide element, and reaches the fuel release lip while a predistribution is performed in the circumferential direction, and it is then moved farther from the fuel release lip in the radially outward direction to the flow guide surface of the first flow guide element.

Reliable transport of the fuel along the second flow guide element in the direction of the fuel release lip can be ensured by the surface normal in the surface area of the second flow guide element being directed essentially opposite a stream flowing through the first flow space area.

According to an especially advantageous embodiment, the most uniform fuel feed possible can be achieved by providing a plurality of fuel feed channel sections in the second flow guide element, which are open toward respective surface areas of the second flow guide element at opening areas following each other in the circumferential direction in relation to a central axis of the nozzle. Furthermore, it is advantageous for the at least one fuel feed channel section to open into the surface area essentially in the direction of the surface normal.

To support the reliable transport of the amount of fuel being discharged by the second flow guide element in the radially outward direction, it is proposed that at least one deflecting element be provided to generate a swirling flow in the first flow space area. By providing a swirl in the air stream flowing through the first flow space areas, it is ensured that by generating corresponding centrifugal forces, the fuel particles being released by the second flow guide element are thrown radially outwardly in the direction of the flow guide surface of the first flow guide element.

To ensure a uniform and reliable atomization of the fuel fed to the first flow guide element in the atomizing nozzle according to the present invention, it is proposed that the first flow guide element define a second flow space area together with a third flow guide element.

According to another aspect, the present invention pertains to a heater with an atomizing nozzle. A fuel feed system can then be provided in this heater for feeding fuel to the at least one fuel feed channel section under a pressure of up to 2.0 bar and preferably up to 1.5 bar above the pressure prevailing in the first flow space area.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
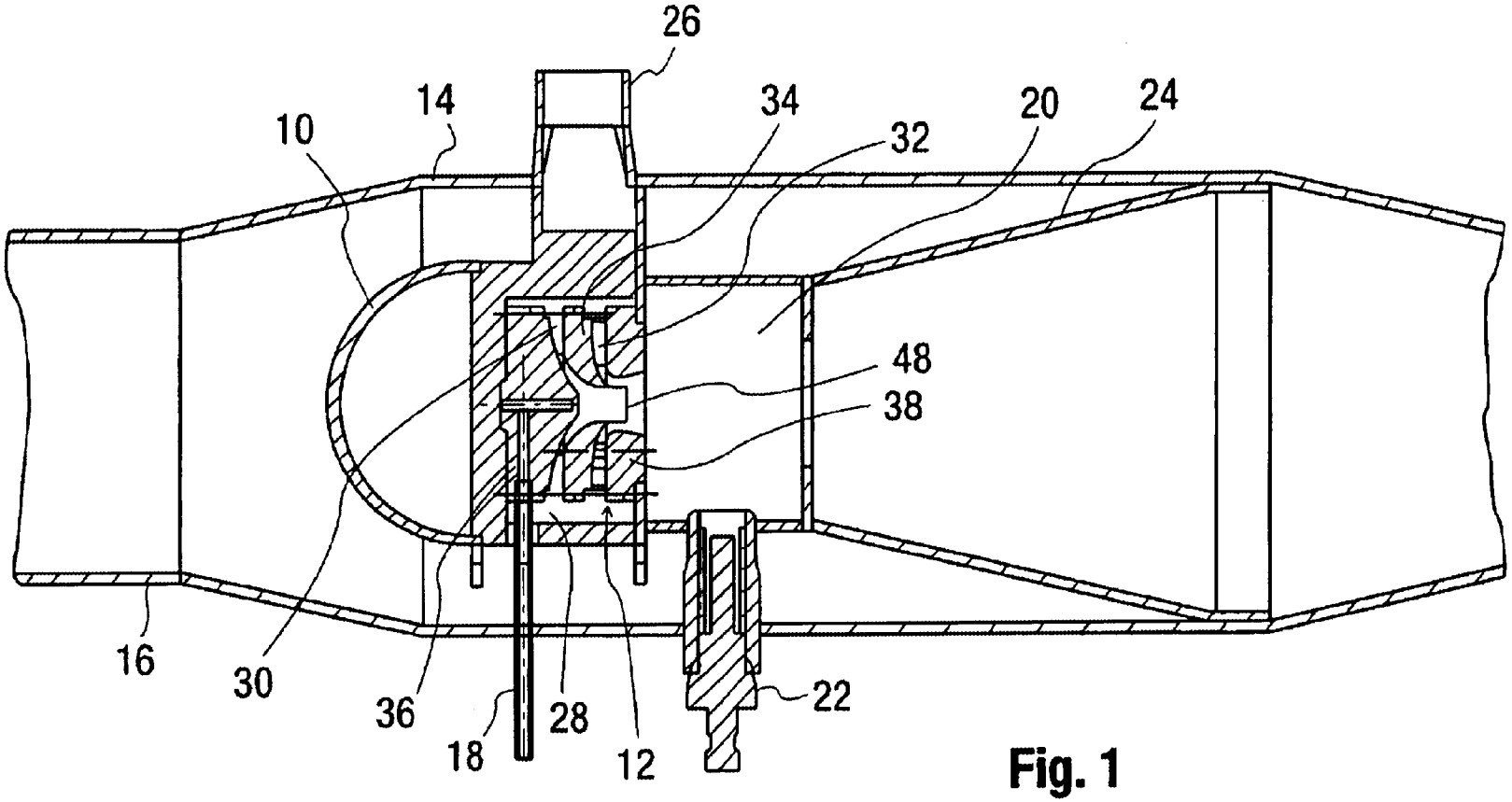
FIG. 1 is a schematic longitudinal sectional view of an exhaust gas guiding system in a motor vehicle, in which a heater with an atomizing nozzle according to the present invention is provided.

Referring to the drawings in particular, before describing the design of atomizing nozzles according to the present invention below with reference to FIGS. 2 and 3, an overall system, in which a heating burner, which is generally designated by 10 and which has an atomizing nozzle 12 according to the present invention, is provided, will be first described with reference to FIG. 1. The heating burner 10 is arranged in an expanded section 14 of an exhaust gas guide system 16 in a motor vehicle. The fuel fed in via a fuel line 18 is atomized in the atomizing nozzle 12 and is burned in a combustion chamber 20 together with the combustion air likewise fed in via the atomizing nozzle 12. This combustion is induced by an igniting member 22, e.g., a glow-type ignition pin. The combustion waste gases which flow to the heating burner 10 from the upstream direction and then flow around same radially outwardly from an internal combustion engine flow through a perforated plate 24 of conical design and are heated in the process by the heated combustion waste gases of the heating burner 10 which leave the combustion chamber 20 such that they contribute to the regeneration of a particle filter farther downstream.

It is apparent that the heating burner 10 according to the present invention with the atomizing nozzle 12 provided therein may also be used in other system areas, e.g., a parking heater, an auxiliary heater or a so-called catalytic converter heater for preheating a catalytic converter.

It shall also be stated concerning the design of the atomizing nozzle 12 with reference to FIG. 1 that air is fed into it from the radially outward direction via an air feed area 26, and this air is then split into two flow space areas 30, 32 in an annular space area 28. The two flow space areas 30, 32 are separated from one another by a first flow guide element 34. Together with a second flow guide element 36, which can also be considered to be a bottom part, the first flow guide element 34 defines the first flow space area 30, while the first flow guide element 34 together with a third flow guide element 38 defines the second flow space area 32. The detailed design of this atomizing nozzle 12 will be first described in more detail with reference to FIG. 2.

The first flow guide element 34 provides respective flow guide surfaces 40, 42 on its two sides. The first flow guide element 34 can be recognized in detail in FIG. 2. Together with a flow guide surface 44 of the second flow guide element 36, the radially inner flow guide surface 40 defines the first flow space area 30. The radially outer flow guide surface 42 defines the second flow guide space area 32 with a flow guide surface 46 of the third flow guide element 38. The two flow guide surfaces 40, 42 of the first flow guide element 34, which are essentially rotationally symmetrical in relation to a central axis A of the nozzle and are tapered asymptotically, end in an atomizing lip 48 in an approximately cylindrical end section of the flow guide surfaces 40, 42.

Blade-like deflecting elements 50, 52 ensure that the air stream entering in the radially inward direction from the annular space will acquire a circumferential flow direction component, so that an inner swirling flow $S_i$ and an outer swirling flow $S_a$ will be formed. Blade-like deflecting elements 50, 52 are provided in both the first flow space area 30 and the second flow space area 32 between the components defining these two flow space areas 30, 32.

A fuel feed device generally designated by 54 comprises, beginning from a central line 56, a plurality of fuel feed channel sections 58 leading radially outwardly. These are open in respective opening areas 60 toward the flow guide surface 44 of the second flow guide element 36. In the areas in which the opening areas 60 are located, the flow guide surface 44 has such an orientation that the surface normal F has a radial component different from zero, i.e., it is not directed purely axially. It is recognized, furthermore, that at least close to their opening areas 60, the fuel feed channel sections 58 have a direction of extension that is approximately parallel to the surface normal F. Downstream of the opening areas 60, the second flow guide element 36 with its flow guide surface 44 still has a tapered design.

When fuel is introduced via the central line 56 and then the fuel feed channel sections 58, the fuel is already released with a substantial radial component into the flow space area 30. The radial movement of the fuel is additionally supported by the fact that the fuel is caught by the inner swirling flow $S_i$ at the time of discharge from the opening areas 60 and it likewise acquires a circumferential movement component due to the inner swirling flow. The fuel is thrown radially outwardly at increased intensity due to the centrifugal forces generated in the process, so that it will finally reach the flow guide surface 40 of the first flow guide element 34 in a reliable manner. A fuel film 62 is formed there, which will then move in the direction of the atomizing lip 48 under the action of the inner swirling flow $S_i$ flowing through the flow space area 30. The fuel is atomized at the atomizing lip by the shearing action of the two swirling flows $S_i$ and $S_a$ in order to then generate an ignitable mixture of atomized fuel and combustion air downstream of the atomizing lip 38. The total amount of the combustion air is preferably fed in, in the form of the two swirling flows $S_i$ and $S_a$.

Figure 2:
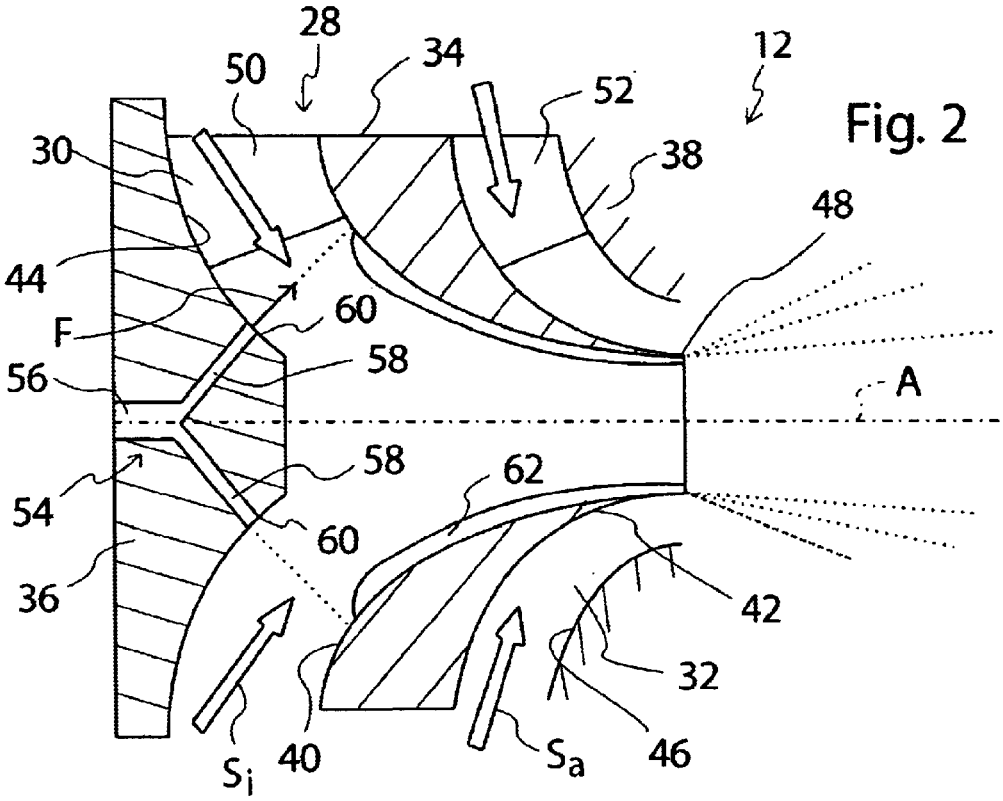
FIG. 2 is an enlarged schematic longitudinal sectional view of a first embodiment of the atomizing nozzle according to the present invention.

It is ensured in the atomizing nozzle shown in FIG. 2 that reliable transport in the direction of the first flow guide element 34 is guaranteed simply by presetting the direction in which the fuel is discharged and, to a greater extent, by the centrifugal forces acting on the fuel. The feeding of the fuel at high velocity, i.e., under high pressure, is not necessary, which makes it possible for the fuel feed system arranged upstream to have a comparatively simple design and, e.g., for the feed of fuel to take place simply under the action of a metering pump, which is able to feed the fuel under a pressure of up to 1.5 or 2.0 bar above the pressure that counteracts the discharge of the fuel from the fuel feed channel sections 58, i.e., in general, the pressure that prevails in the area of the combustion chamber 20 or the flow space area 30.

Figure 3:
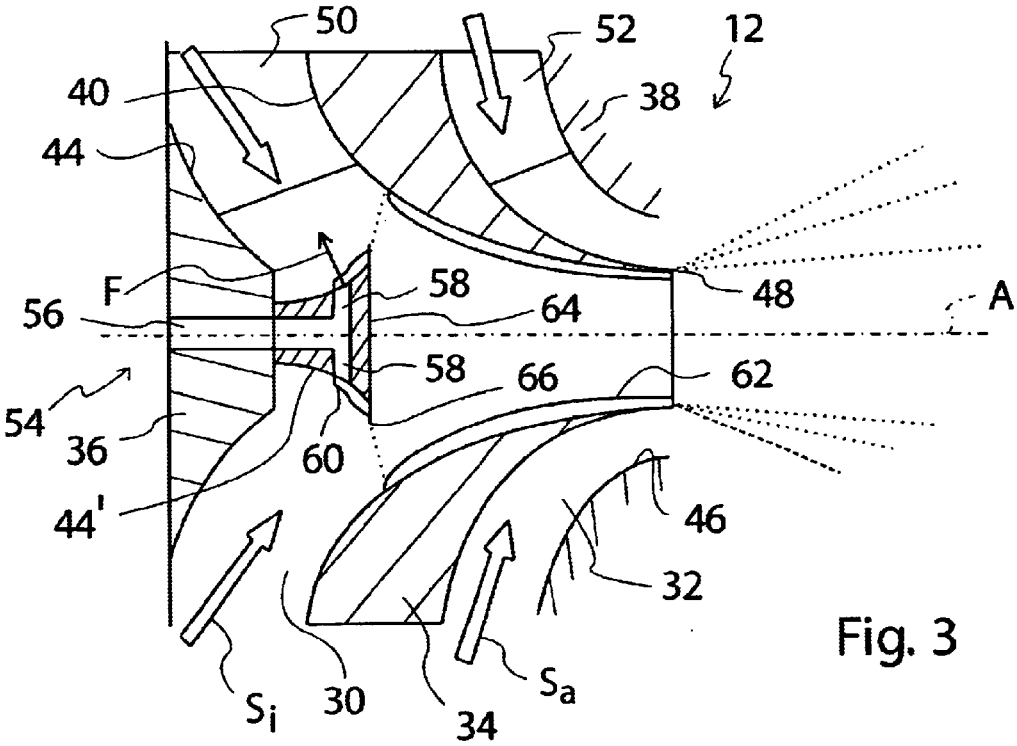
FIG. 3 is a view of an alternative embodiment of the atomizing nozzle according to the present invention corresponding to FIG. 2.

A modified embodiment of the atomizing nozzle 12 according to the present invention is shown in FIG. 3. The components that correspond to the components already described above in terms of design or function are designated with the same reference numbers.

It can be recognized that the second flow guide element 36 is provided here with an end piece 64, which provides an additional section 44' of a flow guide surface of the second flow guide element 36. This end piece 64 may be provided, e.g., as a separate component, but it may also be made integral with the section of the second flow guide element 36, which can also be recognized in FIG. 1. It can be recognized that there is a radial jump or transition in the transition area between the two flow guide surfaces 44, 44'. While the flow guide surface 44 is tapered in the direction of flow toward the central axis A of the nozzle, the flow guide surface 44' begins at this step-like transition area with a small radius, expanding radially. The flow guide surface 44 ends at a fuel release lip, which is designated with the reference number 66 and has an approximately ring-like contour because of the approximately rotationally symmetrical design of the end piece 64. The curvature of the flow guide surface 44' increases in the downstream direction, so that in the area of the release lip 66, the flow guide surface 44' has an axially directed surface normal, which is directed to the left in FIG. 3, i.e., in the direction away from the atomizing nozzle 48.

The fuel feed channel sections 58, whose opening areas 60 are now located at the flow guide surface 44', are again provided in the said end piece 64. Radial extension components of the surface normals deviating from zero are again recognized here in the areas of the flow guide surface 44' in which the opening areas 60 are provided. Because of the expanding shape of the flow guide surface 44', the surface normals F are directed here essentially opposite the inner swirling flow $S_i$ if the circumferential flow component of this swirling flow is ignored. The fuel being discharged from the fuel feed channel sections 48 is carried by the inner swirling flow $S_i$, and such a dynamic pressure is generated here, especially also because of the expanding shape of the flow guide surface 44', that the fuel is reliably fed in the direction of the fuel release lip 66. Distribution of the fuel in the circumferential direction is already taking place during this delivery process, so that an approximately uniform fuel partial stream is sent from the fuel release lip 66 in the radially outward direction to the flow guide surface 40 of the first flow guide element 34. The circumferential flow component of the inner swirling flow $S_i$ again makes a substantial contribution in this case as well.

Both embodiments described above have the advantage that reliable release in the radially outward direction can take place even in the case of fuel feed under a comparatively low pressure. It is essential for this that the fuel be already released to the outside with a certain radial flow direction component, which is also supported by the centrifugal forces introduced by means of the swirling flow. It is obvious that various modifications may also be made in the above-described atomizing nozzles. For example, the fuel feed channel sections 58 may open into an area of the second flow guide element 36 depressed in a groove-like manner or into flow guide surfaces 44, 44' thereof. This groove-like depression may be circular in the circumferential direction, so that predistribution of the fuel in the circumferential direction may already take place in this groove-like depression.

While specific embodiments of the invention have been shown and described in detail to illustrate the application of the principles of the invention, it will be understood that the invention may be embodied otherwise without departing from such principles.

What is claimed is:

1. A burner atomizing nozzle for a heater that can be used on a vehicle, comprising:

a first flow guide element providing a flow guide surface and an atomizing lip in an axial end area in relation to a central axis of the nozzle;

a second flow guide element defining a first flow space area leading to the atomizing lip together with the first flow guide element;

a fuel feed device in the second flow guide element for applying fuel through the first flow space area to the flow guide surface of the first flow guide element, the fuel feed device having at least one fuel feed channel section in the second flow guide element, the fuel feed channel section being open toward a surface area of the second flow guide element, the surface area having a surface normal with a radial component, the surface normal being directed not only in an axial direction.

2. An atomizing nozzle in accordance with claim 1, wherein the second flow guide element is tapered downstream of an opening area of a fuel feed channel section, in relation to the central axis of the nozzle.

3. An atomizing nozzle in accordance with claim 1, wherein the second flow guide element is expanded downstream of an opening area of a fuel feed channel section, in relation to the central axis of the nozzle.

4. An atomizing nozzle in accordance with claim 3, wherein the second flow guide element has a fuel release lip downstream of an opening area of the fuel feed channel section.

5. An atomizing nozzle in accordance with claim 4, wherein the surface normal in the surface area of the second flow guide element is directed essentially opposite a stream flowing through the first flow space area.

6. An atomizing nozzle in accordance with claim 1, further comprising fuel feed channel sections provided in the second flow guide element, the fuel feed channel sections being open toward respective surface areas of the second flow guide element at opening areas that follow each other in a circumferential direction in relation to a central axis of the nozzle.

7. An atomizing nozzle in accordance with claim 1, wherein the fuel feed channel section opens into the surface area essentially in the direction of the surface normal.

8. An atomizing nozzle in accordance with claim 1, further comprising a deflecting element provided to generate a swirling flow in the first flow space area.

9. An atomizing nozzle in accordance with claim 1, further comprising a third flow guide element, wherein the first flow guide element defines a second flow space area together with a third flow guide element.

10. A heater, comprising:

an atomizing nozzle with a first flow guide element providing a flow guide surface and an atomizing lip in an axial end area in relation to a central axis of the nozzle, a second flow guide element defining a first flow space area leading to the atomizing lip together with the first flow guide element and a fuel feed device in the second flow guide element for applying fuel through the first flow space area to the flow guide surface of the first flow guide element, the fuel feed device having at least one fuel feed channel section in the second flow guide element, the fuel teed channel section being open toward a surface area of the second flow guide element, the surface area having a direction normal to the surface a with radial component and not only directed in an axial direction.

11. A heater in accordance with claim 10, wherein a fuel feed system is provided for feeding fuel to the fuel feed channel section under a pressure of up to 2.0 bar above the pressure prevailing in the first flow space area.

12. A heater in accordance with claim 10, wherein a fuel feed system is provided for feeding fuel to the fuel feed channel section under a pressure of up to 1.5 bar above the pressure prevailing in the first flow space area.

13. A vehicle heater burner atomizing nozzle, comprising:

a first flow guide element having a flow guide surface and an atomizing lip in an axial end area in relation to a central axis of the nozzle;

a second flow guide element cooperating with said first flaw guide element to define a first flow space area leading to the atomizing lip;

a fuel feed device associated with the second flow guide element for directing fuel through the first flow space area to the flow guide surface of the first flow guide element, the fuel feed device having at least one fuel feed channel section in the second flow guide element, the fuel feed channel section being open toward a surface area of the second flow guide element, the surface area having a surface extending in a direction between an axial direction and a radial direction.

14. An atomizing nozzle in accordance with claim 12, wherein the second flow guide element is tapered downstream of an opening area of a fuel feed channel section, in relation to the central axis of the nozzle.

15. An atomizing nozzle in accordance with claim 13, wherein the second flow guide element extent radially outwardly downstream of an opening area of a fuel feed channel section, in relation to the central axis of the nozzle.

16. An atomizing nozzle in accordance with claim 15, wherein the second flow guide element has a fuel release lip downstream of an opening area of the fuel feed channel section.

17. An atomizing nozzle in accordance with claim 16, wherein the surface in the surface area of the second flow guide element is directed essentially opposite a stream flowing through the first flow space area.

18. An atomizing nozzle in accordance with claim 13, further comprising fuel feed channel sections provided in the second flow guide element, the fuel feed channel sections being open toward respective surface areas of to second flow guide element at opening areas that follow each other in a circumferential direction In relation to a central axis of the nozzle.

19. An atomizing nozzle in accordance with claim 13, wherein the fuel feed channel section opens into the surface area essentially in the direction of the surface normal.

20. An atomizing nozzle in accordance with claim 13, further comprising a deflecting element provided to generate a swirling flow in the first flow space area.

21. An atomizing nozzle in accordance with claim 13, further comprising a third flow guide element, wherein the first flow guide element defines a second flow space area together with a third flow guide element.

* * * * *